US008388460B1

(12) United States Patent
Schantz

(10) Patent No.: US 8,388,460 B1
(45) Date of Patent: Mar. 5, 2013

(54) PUTTER SITE ORIENTING DEVICE

(76) Inventor: John J. Schantz, Swartz Creek, MI (US)

( * ) Notice: Subject to any disclaimer, the term of this patent is extended or adjusted under 35 U.S.C. 154(b) by 0 days.

(21) Appl. No.: 13/200,563

(22) Filed: Sep. 26, 2011

(51) Int. Cl.
*A63B 69/36* (2006.01)

(52) U.S. Cl. ..... 473/223; 473/238

(58) Field of Classification Search ..... 473/219, 473/223, 226, 228, 229, 231, 238, 257, 266, 473/268, 409
See application file for complete search history.

(56) References Cited

U.S. PATENT DOCUMENTS 3,198,525 A * 8/1965 Smith ..... 473/238
4,949,971 A * 8/1990 Thornton ..... 473/238
4,953,867 A * 9/1990 Rigsby ..... 473/238
5,441,270 A * 8/1995 Williams ..... 473/251

* cited by examiner

*Primary Examiner* — Nini Legesse

(57) ABSTRACT

A putter site orienting device and method that linearly aligns a putter having a shaft longitudinal axis, a gripping portion, a putting head, a golf ball having indicia marked thereon, and target golf hole including a putter shaft attaching portion having a contoured face that attaches to the shaft; a magnet integrally formed with the shaft attaching portion that magnetically secures device to the shaft; a rigid rod having a longitudinal axis and a diameter Dr substantially smaller then a diameter Dp of the shaft integrally formed with the shaft attaching portion including a first end integrally formed with the shaft attaching portion, and second free end opposite the first end wherein the rigid rod protrudes outwardly and perpendicularly from the shaft attaching portion to allow proper alignment of a putter to which the device attaches with respect to both a golf ball and to a target golf hole.

17 Claims, 12 Drawing Sheets

PUTTER SITE ORIENTING DEVICE

FIELD OF INVENTION

The disclosed invention relates to an improved golf training aid and more particularly to a portable attachment for a golf putter which promotes both proper positioning of the putter and alignment of the putter with respect to the golf ball and the target hole.

BACKGROUND

Previous golf putting sighting devices have required either the proper position to be assumed by the golfer or proper orientation of the putter head in order to benefit fully from use of the device. What is needed is a device that properly aligns a putter with a golf ball and target hole.

SUMMARY OF THE INVENTION

A putter site orienting device that linearly aligns a putter having a shaft longitudinal axis, a gripping portion, a putting head, a golf ball having indicia marked thereon, and target golf hole including a putter shaft attaching portion having a contoured face that attaches to the shaft; a magnet integrally formed with the shaft attaching portion that magnetically secures device to the shaft; a rigid rod having a longitudinal axis and a diameter Dr substantially smaller then a diameter Dp of the shaft integrally formed with the shaft attaching portion including a first end integrally formed with the shaft attaching portion, and second free end opposite the first end wherein the rigid rod protrudes outwardly and perpendicularly from the shaft attaching portion to allow proper alignment of a putter to which the device attaches with respect to both a golf ball and to a target golf hole.

A method of using the putter site orienting device to allow proper alignment of a putter to which the device attaches with respect to both a golf ball and to a target golf hole is also disclosed.

Figure 10:
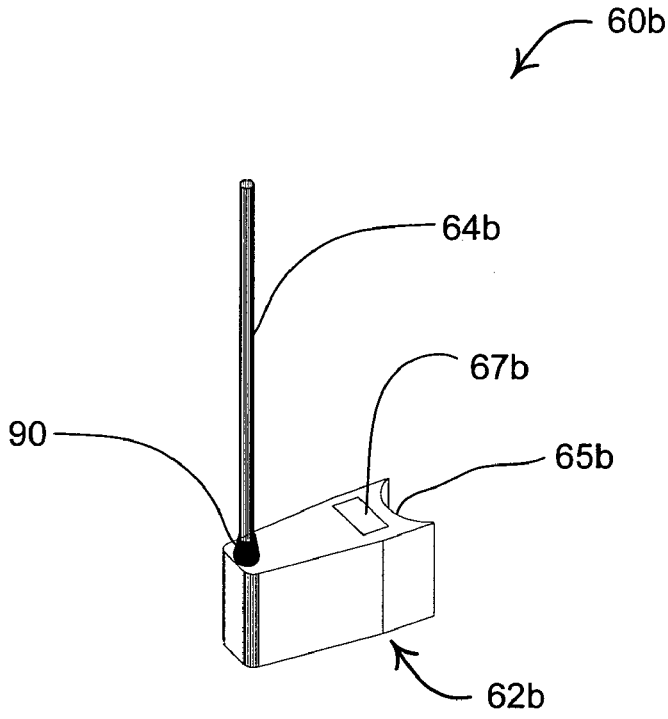
FIG. 10 illustrates a perspective view of a putter site orienting device in accordance with an embodiment of the invention.

DRAWING REFERENCE NUMBERS a putter 30
a gripping section 32
gripping portion opening 34
putter shaft 36
putting head 40*a*
putter head face 40*b*
a golf ball 42
golf ball indicia 44
target golf hole 46
shaft longitudinal axis 48
the green 50
lines 52*a*, 52*b*, 52*c*
a putter site orienting device 60*a*, 60*b*
a putter shaft attaching portion 62*a*, 62*b*
a thin rigid rod 64*a*, 64*b*
at least one contoured surface 65*a*, 65*b* at least one magnet 67*a*, 67*b*
rigid rod first end 66*a*, 66*b*
magnet 67*a*, 67*b*
rigid rod second free end 68*a*, 68*b*
planar top surface 70*a*, 70*b*
bottom planar surface 72*a*, 72*b*
two opposing sides 74*a*, 76*a*, 74*b*, 76*b*
first and second substantially parallel face 78*a*, 82*a*, 78*b*, 82*b*
vertical rod longitudinal axis 80*a*, 80*b*
opposing third and fourth angled faces 84*a*, 86*a*, 84*b*, 86*b*
rear contoured face 88*a*, 88*b*
a front face 89*a*, 89*b*
front face rounded edges 91*a*, 93*a*, 91*b*, 93*b*
tapered mount 90
tapered mount narrow section 92
tapered mount wider section 94
shaft first side 96
shaft second side 98
method 100
method steps 102, 104, 106, 108, 110, 112, 114

DETAILED DESCRIPTION OF THE INVENTION

Figure 1:
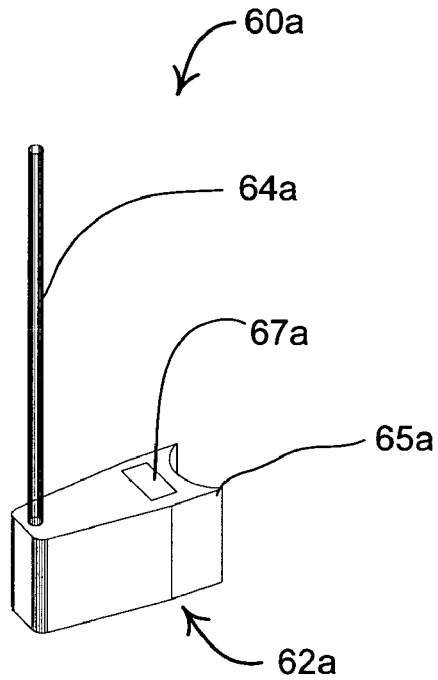
FIG. 1 illustrates a perspective view of a putter site orienting device in accordance with an embodiment of the invention.
Figure 2:
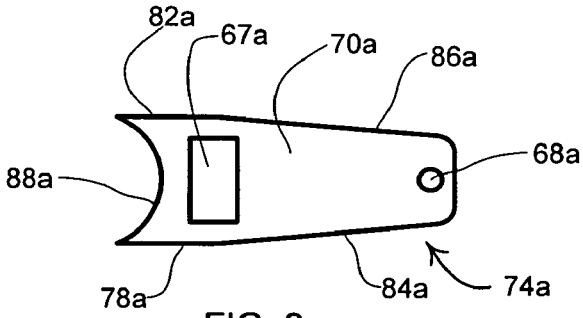
FIG. 2 illustrates a top plan view of the putter site orienting device shown in FIG. 1 in accordance with an embodiment of the invention.
Figure 4:
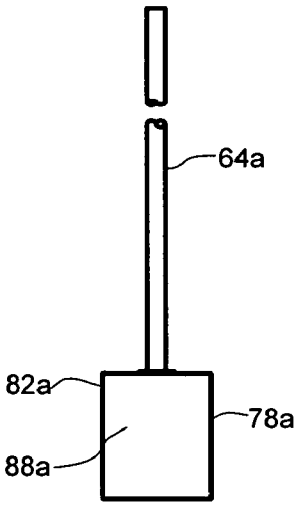
FIG. 4 illustrates a rear elevational view of the putter site orienting device shown in FIG. 1 in accordance with an embodiment of the invention.
Figure 3:
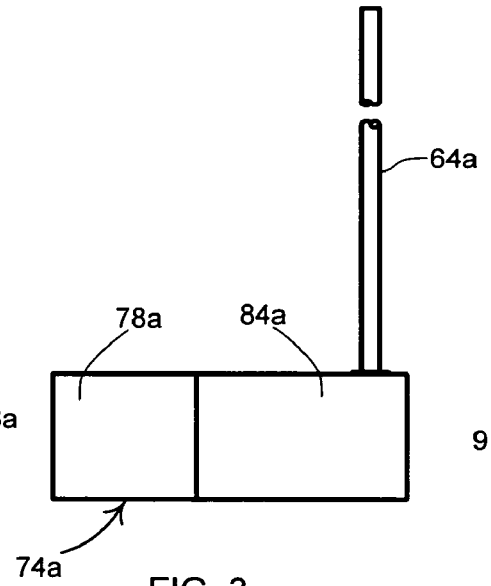
FIG. 3 illustrates a side elevational view of the putter site orienting device shown in FIG. 1 in accordance with an embodiment of the invention.
Figure 5:
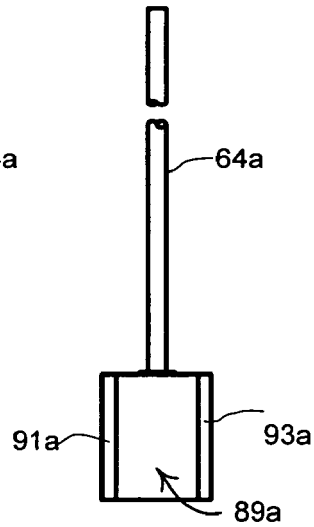
FIG. 5 illustrates a front elevational view of the putter site orienting device shown in FIG. 1 in accordance with an embodiment of the invention.
Figure 6:
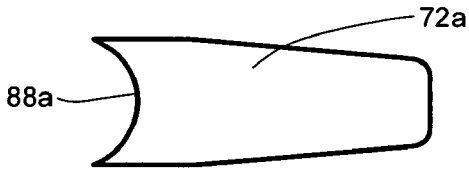
FIG. 6 illustrates a bottom plan view of the putter site orienting device shown in FIG. 1 in accordance with an embodiment of the invention.
Figure 7:
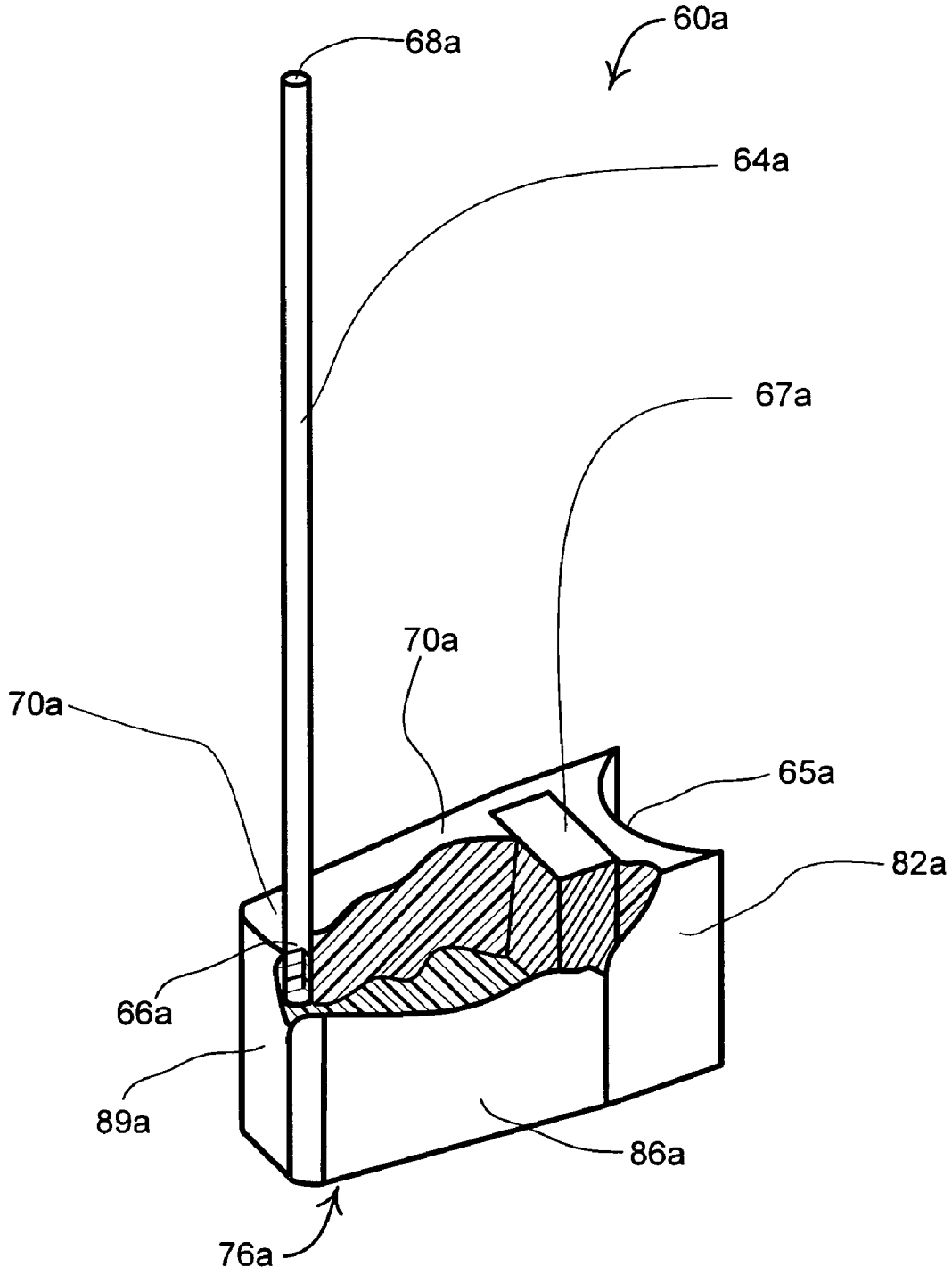
FIG. 7 is a perspective view of the putter site orienting device shown in FIG. 1 partially broken away.
Figure 11:
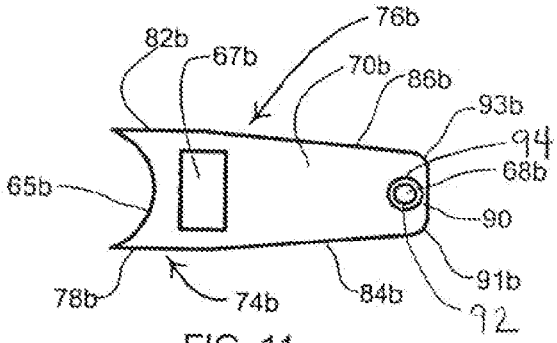
FIG. 11 illustrates a top plan view of the putter site orienting device shown in FIG. 10 in accordance with an embodiment of the invention.
Figures 12, 13, 14:
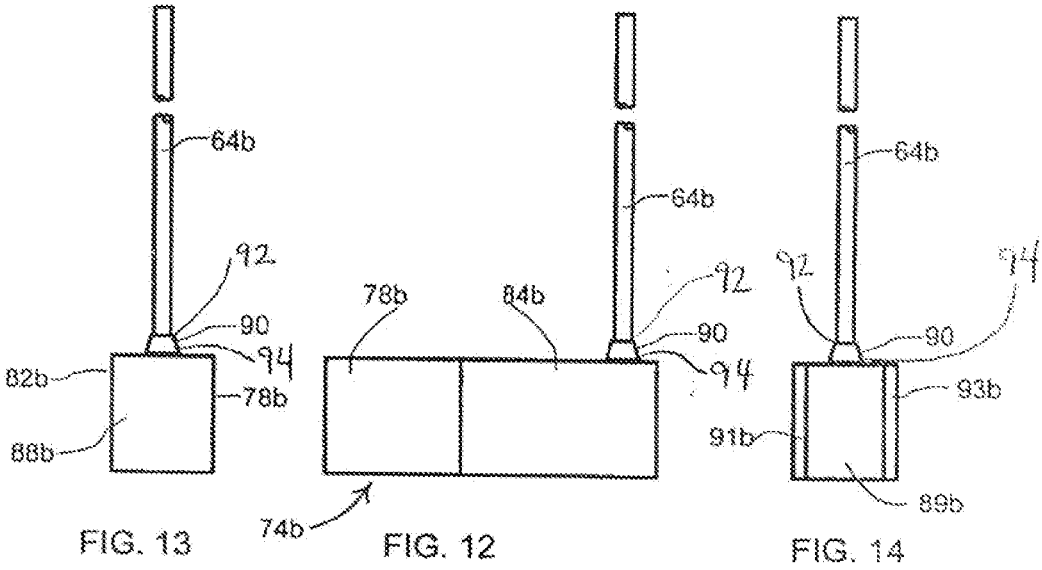
FIG. 12 illustrates a side elevational view of the putter site orienting device shown in FIG. 10 in accordance with an embodiment of the invention.
FIG. 13 illustrates a rear elevational view of the putter site orienting device shown in FIG. 10 in accordance with an embodiment of the invention.
FIG. 14 illustrates a front elevational view of the putter site orienting device shown in FIG. 10 in accordance with an embodiment of the invention.
Figure 15:
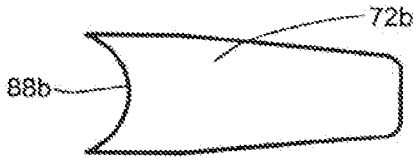
FIG. 15 illustrates a bottom plan view of the putter site orienting device shown in FIG. 10 in accordance with an embodiment of the invention.
Figure 16:
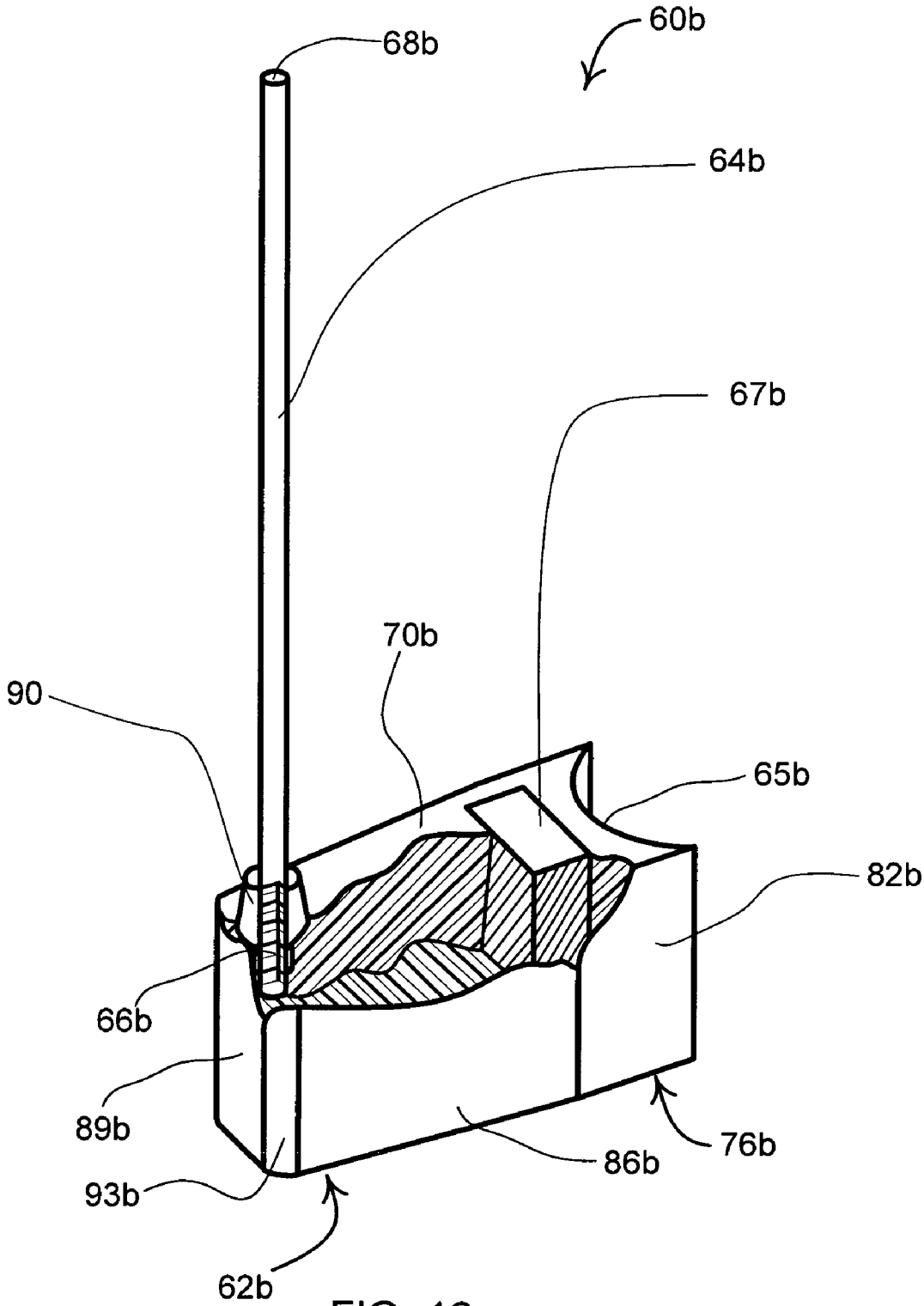
FIG. 16 is a perspective view of the putter site orienting device shown in FIG. 10 partially broken away.

FIGS. 1 and 10 respectively illustrate perspective views of two embodiments of a putter site orienting device 60*a*, 60*b*. FIGS. 2 and 11 respectively illustrate a top plan view of the putter site orienting device 60*a*, 60*b*, each respectively shown in FIGS. 1 and 10. FIGS. 3 and 12 respectively illustrate a side elevational view of the putter site orienting device 60*a*, 60*b*, each respectively shown in FIGS. 1 and 10. FIGS. 4 and 13 respectively illustrate a rear elevational view of the putter site orienting device 60*a*, 60*b*, each respectively shown in FIGS. 1 and 10. FIGS. 5 and 14 respectively illustrate a front elevational view of the putter site orienting device 60*a*, 60*b*, each respectively shown in FIGS. 1 and 10.

Putter site orienting device 60*a*, 60*b* may be made of any suitable plastic, wood, metal, glass or other durable material that can withstand the usage and handling that can be expected during the carrying and use of the putter by the golfer.

Thus, it will be understood that the putter site orienting device 60*a*, 60*bs* which are herein illustrated are merely preferred embodiments of the invention and that the length, size and shape of the putter site orienting device 60*a*, 60*b* will vary depending on the material and the preferred location of the putter site orienting device 60*a*, 60*b* on the shaft 36.

FIGS. 1-9, and FIGS. 10-18 respectively illustrate a putter site orienting device 60*a*, 60*b* for providing a linear alignment between a putter 30 having a shaft with a shaft longitudinal axis and a gripping section, a golf ball 42 having indicia 44 marked thereon, and target golf hole 46 on the green 50 having a centerline 52*c* (See FIGS. 9 and 18) including: a putter shaft attaching portion 62*a*, 62*b* having at least one contoured face 65*a*, 65*b* adapted to attach to and slide along a length of a putter shaft 36; at least one magnet 67*a*, 67*b* integrally formed with the putter shaft attaching portion 62*a*, 62*b* adapted to magnetically secure the putter site orienting device 60*a*, 60*b* to a putter shaft 36; a thin rigid rod 64*a*, 64*b* having a longitudinal axis 80*a*, 80*b* and a diameter Dr substantially smaller then a diameter Dp of a golf club putter shaft integrally formed with the putter shaft attaching portion 62*a*, 62*b* including a first end 66*a*, 66*b* integrally formed with the putter shaft attaching portion 62*a*, 62*b* and a second free end 68*a*, 68*b* opposite the first end 66*a*, 66*b*, wherein the rigid rod 64*a*, 64*b* protrudes outwardly and perpendicularly from the shaft attaching portion 62*a*, 62*b* to allow proper alignment of a putter to which the clear line putter site orienting device 60*a*, 60*b* attaches with respect to both a golf ball and to a target golf hole.

Referring now to FIGS. 1-7 and 10-16, the putter site orienting device 60*a* has a planar top surface 70*a*, 70*b* having a first outer profile, a bottom planar surface 72*a*, 72*b* opposing the top surface 70*a*, 70*b* having a second outer profile that is the same as the first outer profile of the top planar surface 70*a*, 70*b*, two opposing sides 74*a*, 76, 74*b*, 76*b* each having a pair of opposing first and second substantially parallel faces 78*a*, 82*a*, 78*b*, 82*b* and a pair of opposing third and fourth angled faces 84*a*, 86*a*, 84*b*, 86*b*, a rear contoured face 65*a*, 65*b* adapted to attach to the shaft 36 bound between the respective first and second parallel faces 78*a*, 82*a*, 78*b*, 82*b* and between the top and bottom planar surfaces 70*a*, 70*b*, 72*a*, 72*b*, and a front face 89*a*, 89*b* opposing the rear contoured face having slightly rounded edges 91*a*, 93*a*, 91*b*, 93*b* bound between the respective first and second angled faces and the top and bottom planar surfaces. In an embodiment of the invention, the magnet 67*a*, 67*b* is disposed through the top planar surface as shown in FIGS. 1-2 and 10-11 and in more detail in FIGS. 7 and 16, wherein the magnet is placed through the top planar surface in closer proximity to the rear contoured face than to the front face. However, the magnet may be integrally formed anywhere within the putter shaft attaching portion as long as the magnetic properties are sufficient to magnetically attach the device 60*a*, 60*b* to the shaft.

Although a magnet is described herein to attach the putter site orienting device 60*a*, 60*b* to a putter shaft, other putter site orienting device securement means that have or may come into existence may be used to removably secure the putter site orienting device 60*a*, 60*b* to a golf putter such as but not limited to a clamp and set screw.

The rear contoured face 65*a*, 65*b* has a complementary concave shape to the convex shape of a putter shaft adapted to partially encircle a putter shaft, wherein the rear contoured face 65*a*, 65*b* of the putter site orienting device 60*a*, 60*b* fits snugly along a given section of the shaft of the putter such that the rigid rod is substantially parallel to or is parallel to the shaft longitudinal axis 48. Additionally, the rigid rod is an elongated member that is remote from the shaft-attaching rear contoured face in closer proximity to the front face.

Figure 8:
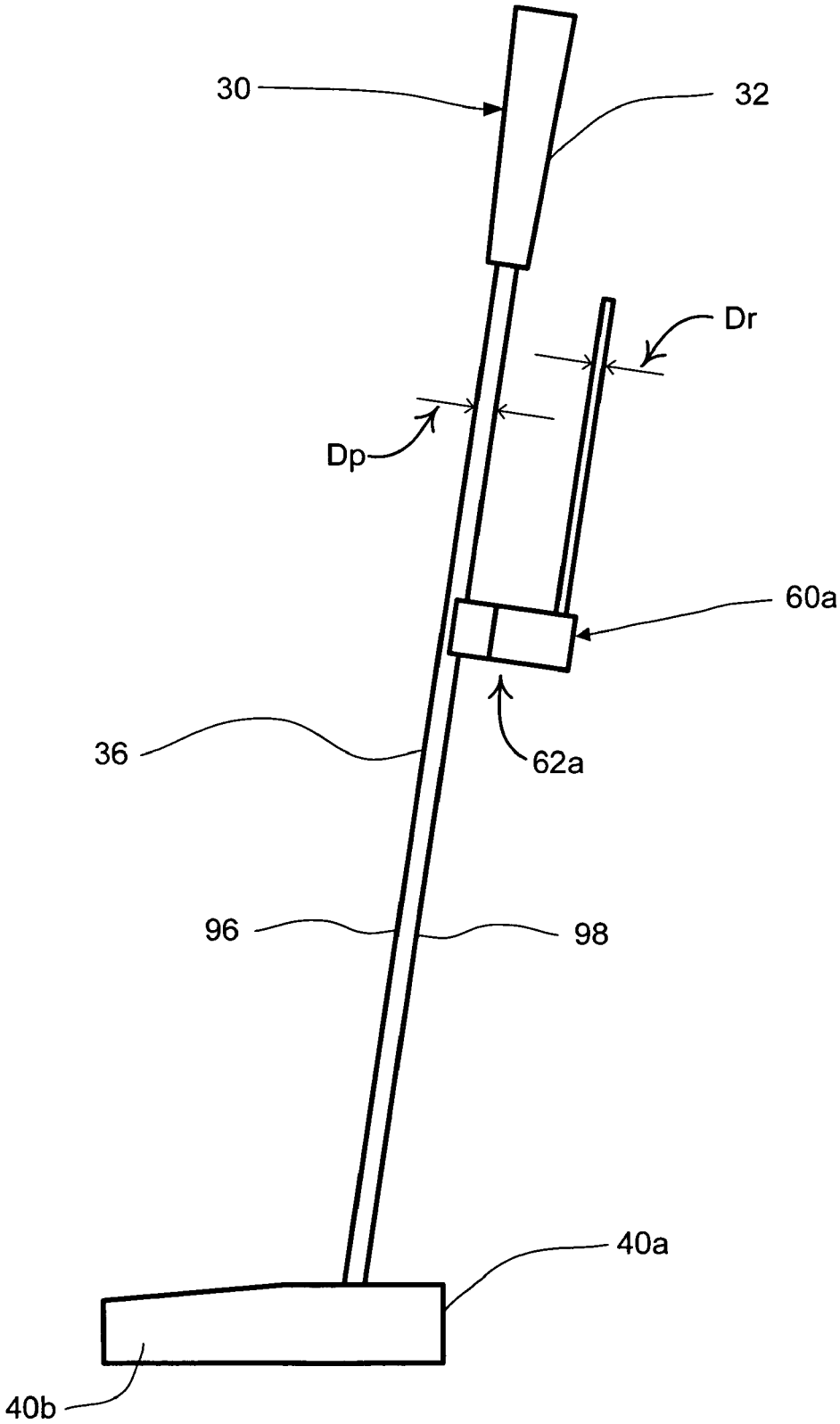
FIG. 8 is side elevational view of the putter and the putter site orienting device shown in FIG. 1 attached thereto, wherein the putter shaft and a vertical rod of the putter site orienting device are parallel.
Figure 17:
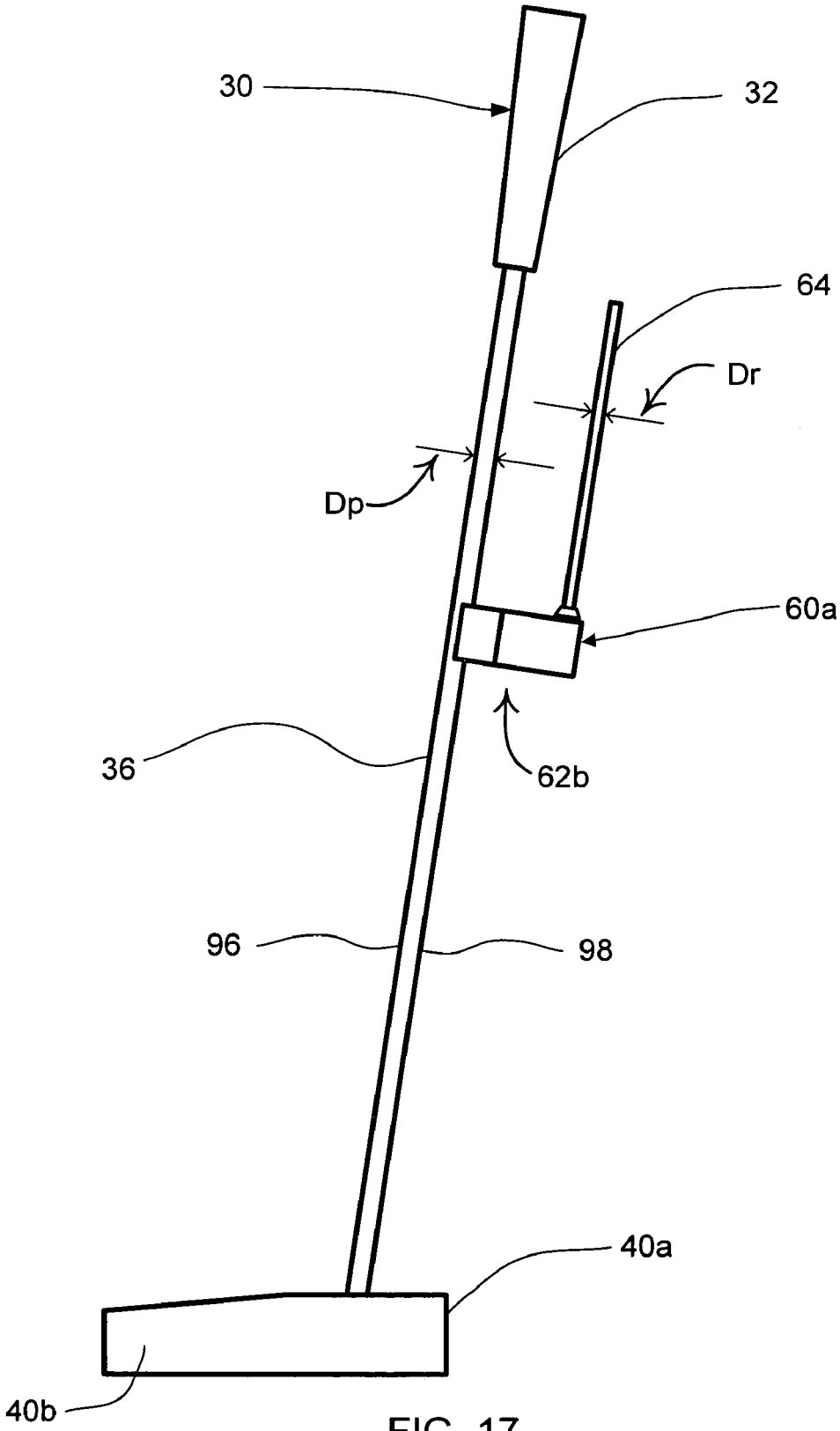
FIG. 17 is side elevational view of the putter and the putter site orienting device shown in FIG. 10 attached thereto, wherein the putter shaft and a vertical rod of the putter site orienting device are parallel.
Figure 19:
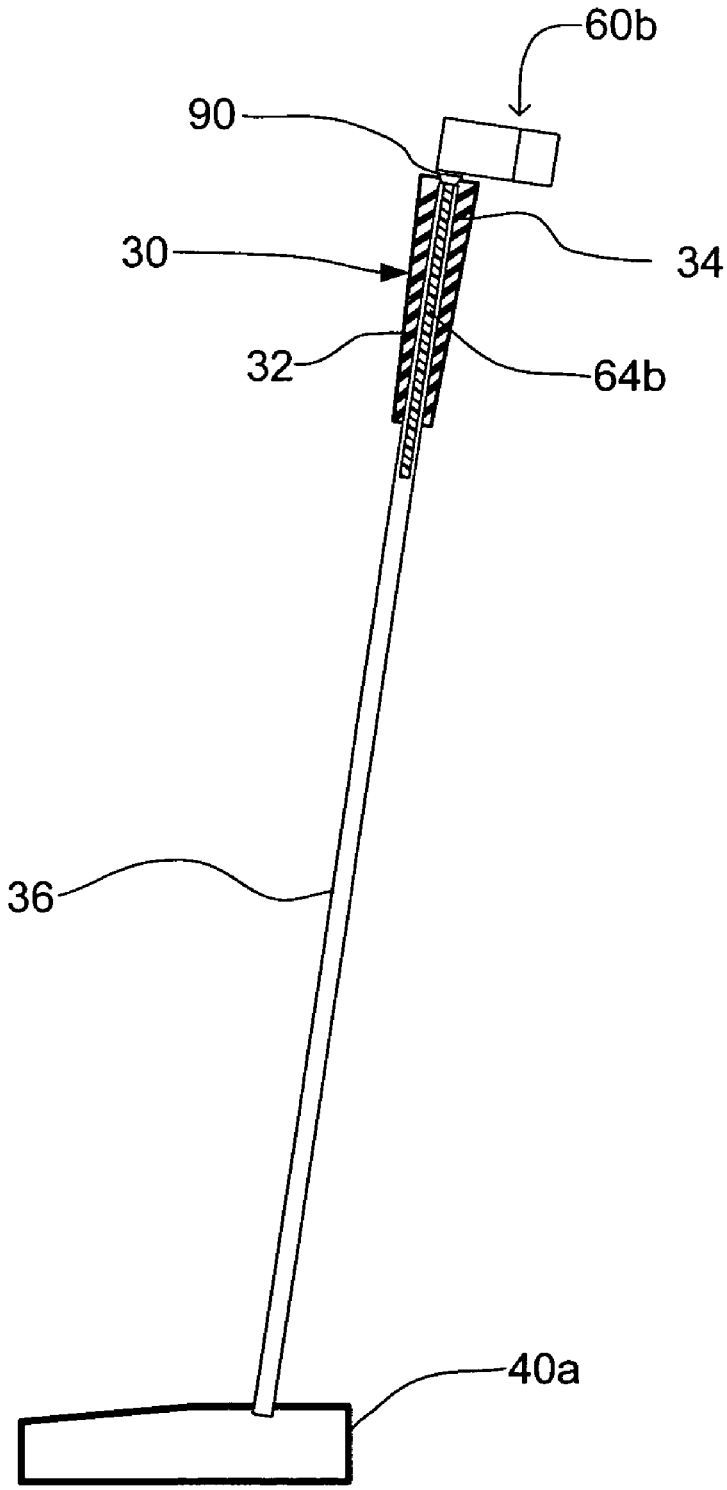
FIG. 19 is a side elevational partial cross-sectional view of the putter and putter site orienting device shown in FIG. 10, wherein the vertical rod of the putter site orienting device is longitudinally disposed within the opening of the putter grip.

Referring to the drawings, FIGS. 8, 17, and 19 show a putter generally designated 30. The putter 30 conventionally includes any suitable elongated shaft 36 with a shaft longitudinal axis 38 having a putting head 40*a* that extends perpendicularly outwardly from the shaft longitudinal axis and from a first side 96 of the shaft and associated putter head face 40*b* at one end which as is well known will have a variety of shapes and sizes. At the end of the shaft remote from the putting head 40*a* a gripping section 32 having an opening disposed therein generally designated 34 will be formed on the shaft 36, wherein the gripping section may take a variety of forms but generally includes a wound covering of material which may be leather or vinyl or other suitable natural or synthetic plastic material adapted for this purpose or it may be an elasticized sleeve which is fixed in position by any suitable means such as an adhesive.

The making of gripping sections for putters and other golf clubs is well known so that further description thereof for the purposes of the present application is not necessary as the construction of such gripping sections will be understood by those skilled in the art.

The putter site orienting device 60*a*, 60*b* may be attached at any point along the shaft as desired by the user to facilitate the orientation of the putter with respect to the golf ball and the target hole. When the putter site orienting device 60*a*, 60*b* is removably secured to the shaft 36, the second end 68*a*, 68*b* of the top of the rigid rod extends in a direction substantially parallel to or parallel to the shaft longitudinal axis away from the putting head and towards the gripping section so that the second free end of the rigid thin rod is closer to the putter gripping section than the first end.

Further, it will be noted from FIGS. 8-9, and 17-18 of the drawings that the putter site orienting device 60*a*, 60*b* is disposed on the shaft 36 of the putter 30 so that the rigid rod longitudinal axis 80*a*, 80*b* is substantially parallel to or is parallel to the shaft longitudinal axis 38 of the shaft 36 but on a second side 98 of the shaft 36 remote from the first side 96 of the shaft from which the putting head 40 extends outwardly. In an embodiment of the invention, a golf ball has locating indicia 44 marked on a portion of the ball's surface. A user holds a putter to which the clear line putter site orienting device 60*a*, 60*b* attaches in the user's line of sight; the user orients the putter such that the rigid thin rod creates a straight line between the locating indicia on the golf ball and a golf hole; thereby orienting a putter to which the clear line putter site orienting device 60*a*, 60*b* attaches into proper alignment with a golf ball and a golf hole. Once the putter and the marked ball are properly aligned, a golfer may more accurately swing to deposit the ball into the hole The putter site orienting device 60*a*, 60*b* serves to aid in positioning the putter shaft 36 in alignment with respect to golf ball and the target hole. The device 60*a*, 60*b* is manually detachably secured by the golfer as illustrated in FIGS. 8-9, and 17-18, 20 on a desired location of the shaft 36 of the golf putter 30 above the putter head 40*a*. This is accomplished with a magnetic securement means, shown as magnet 67*a*, 67*b* in FIGS. 1-2, 7, 10-11, 16, that is in magnetic contact with the putter shaft 36 to hold the device rigidly in place and release or separates it therefrom as desired when the magnetic force between the device 60*a*, 60*b* and the shaft 36 is overcome by a stronger force than the magnetic force to separate the device 60*a*, 60*b* from the shaft 36. The putter site orienting device 60*a*, 60*b* attaches to the shaft 36 along the contoured face of the device 60*a*, 60*b*.

Figure 21:
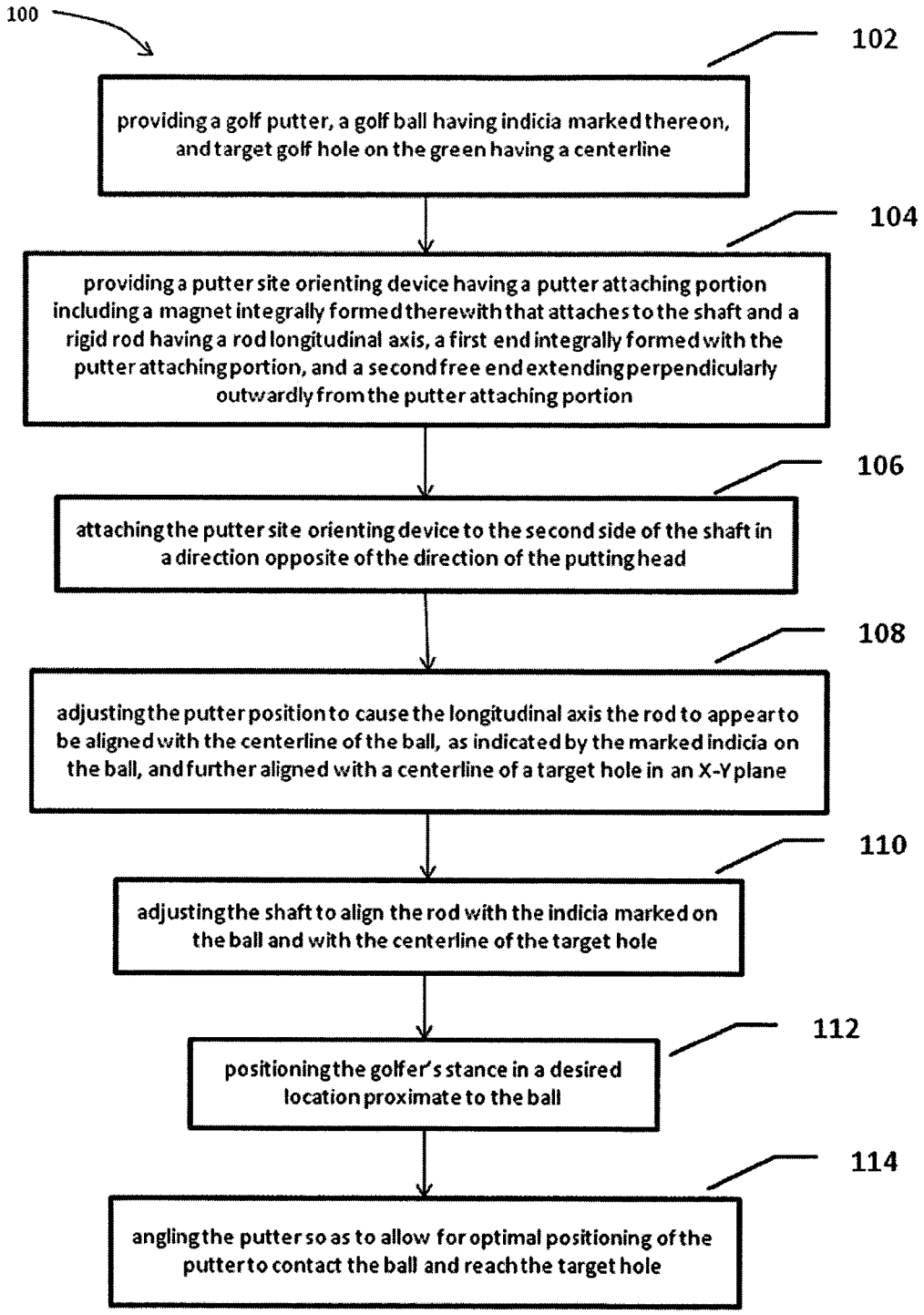
FIG. 21 is a flow chart providing a method of using the putter site orienting device.

In general, a method [100] of using a putter site orienting device shown in FIG. 21 includes:

providing a golf putter having a shaft with a shaft longitudinal axis including a first and a second side, a gripping portion having an opening disposed therein, a putting head and associated putting head face at an end of the shaft remote from the gripping portion extending outwardly perpendicularly from the shaft longitudinal axis and from the first side of the shaft, a golf ball having indicia marked thereon, and target golf hole on the green having a centerline [102];

providing a putter site orienting device having a putter attaching portion including a magnet integrally formed therewith that attaches to the shaft and a rigid rod having a rod longitudinal axis, a first end integrally formed with the putter attaching portion, and a second free end extending perpendicularly outwardly from the putter attaching portion [104];

attaching the putter site orienting device to the second side of the shaft in a direction opposite of the direction of the putting head so that the second free end extends towards the gripping section and away from the putting head in closer proximity to the gripping section than the first end [106];

adjusting the putter position to cause the longitudinal axis the rod to appear to be aligned with the centerline of the ball, as indicated by the marked indicia on the ball, and further aligned with a centerline of a target hole in an X-Y plane [108].

The shaft is adjusted to align the rod with the indicia marked on the ball and with the centerline of the target hole [110], where the rod acts as a sighting device to aid the golfer in aiming the club towards the target hole and ensuring that the putter is properly positioned in a same plane bounded by a first line formed between the second free end of the rod and the target hole, a second line formed between the eye of a user and the marked indicia on the ball, and a third line formed between a centerline of the ball and a centerline of the target hole along which ball rolls.

Once the shaft of the putter is properly adjusted, the golfer's stance is positioned in a desired location proximate to the ball [112]; and the putter is angled [114] so as to allow for optimal positioning of the putter to contact the ball and reach the target hole.

Figure 9:
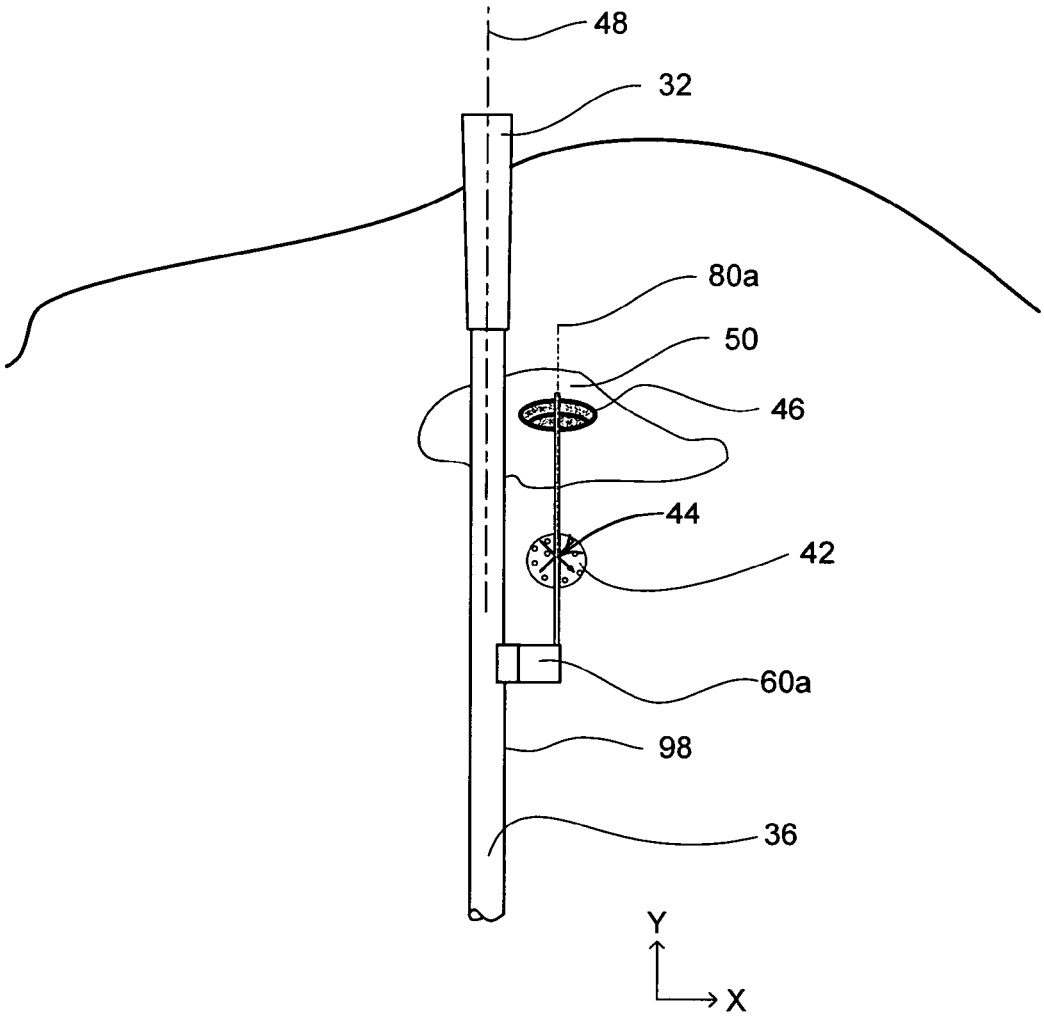
FIG. 9 is a side elevational view of a portion of the putter shaft shown in FIG. 8, the putter site orienting device shown in FIGS. 1 and 8 attached thereto, a ball having indicia marked thereon, a target hole on the green, wherein the vertical rod of the putter site orienting device is in linear alignment with the marked indicia on the ball and a centerline of the target hole.
Figure 18:
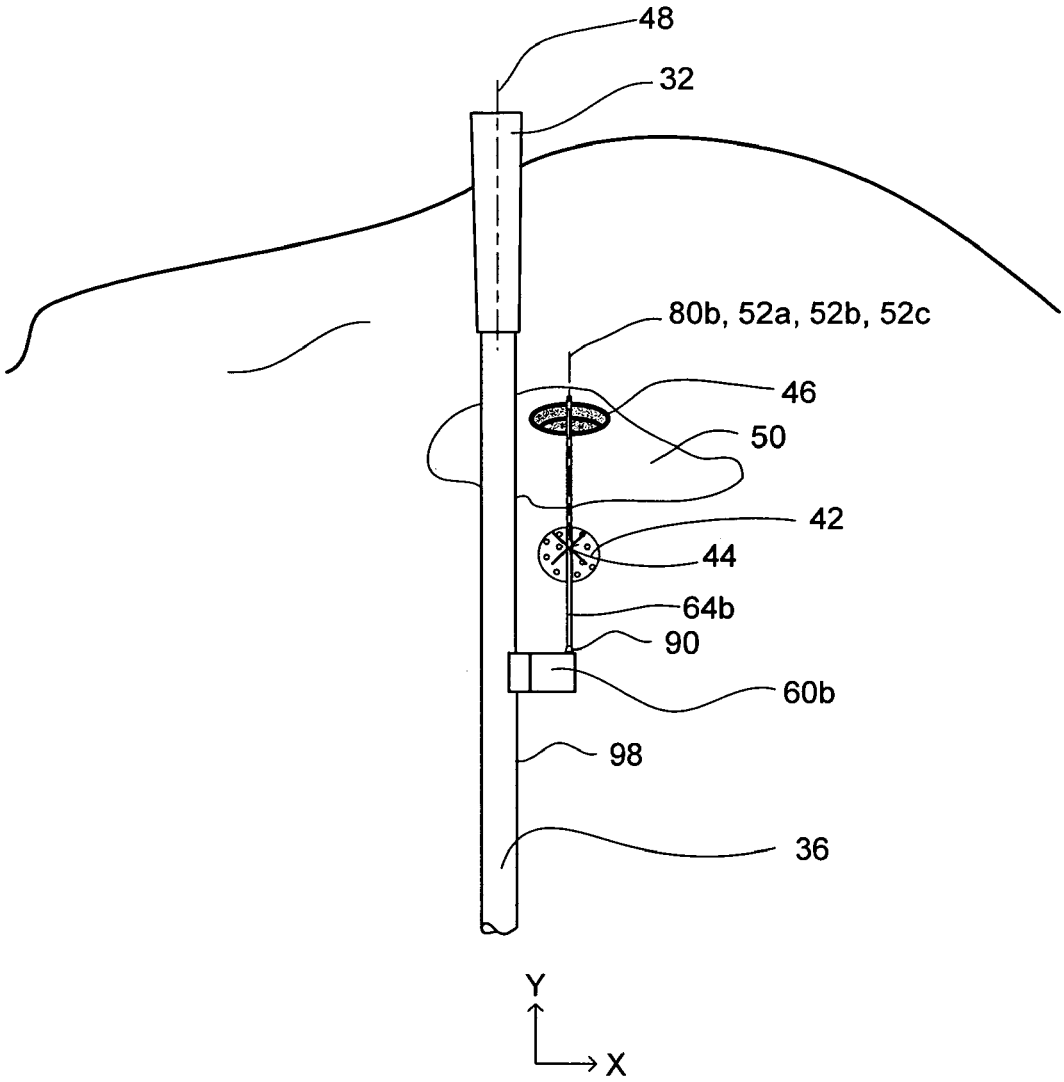
FIG. 18 is a side elevational view of a portion of the putter shaft shown in FIG. 17, the putter site orienting device shown in FIGS. 10 and 17 attached thereto, a ball having indicia marked thereon, a target hole on the green, wherein the vertical rod of the putter site orienting device is in linear alignment with the marked indicia on the ball and a centerline of the target hole.

In use, device is attached via magnetic means along the lower portion of golf putter shaft in the manner of FIGS. 8-9, 17-18 close above head so that the rigid rod appears directly parallel to the longitudinal axis of the shaft to properly position the putter position in alignment with the golf ball and the target hole in the X-Y plane. When the device 60*a*, 60*b* has been properly positioned on the golf club shaft 36, the putter is adjusted to cause the longitudinal axis 80*a*, 80*b* of the rod to appear to be aligned with a centerline of the ball, as indicated by the marked indicia on the ball, and further aligned with a centerline 52*c* of the target hole in the X-Y plane as shown in FIGS. 9 and 18. As shown in FIGS. 9 and 18, in the X-Y plane, the rod longitudinal axis 80*a*, 80*b*, the centerline of the ball 52*b*, the line 52*a* in alignment with the second free end of the rod and the hole, and the hole centerline 52*c* along which the ball rolls all appear to be the same line. However, the actual orientation of the axis 80*a*, 80*b*, lines 52*a*, 52*b*, 52*c* are shown more clearly in FIG. 20, which illustrates a side elevational view aligning a user's eye aligned with the top of the vertical rod and the hole shown along line 52*a* in the Y-Z plane and further aligned with the centerline of the golf ball along line 52*b* and the hole centerline 52*c* in the Y-Z plane.

Figure 20:
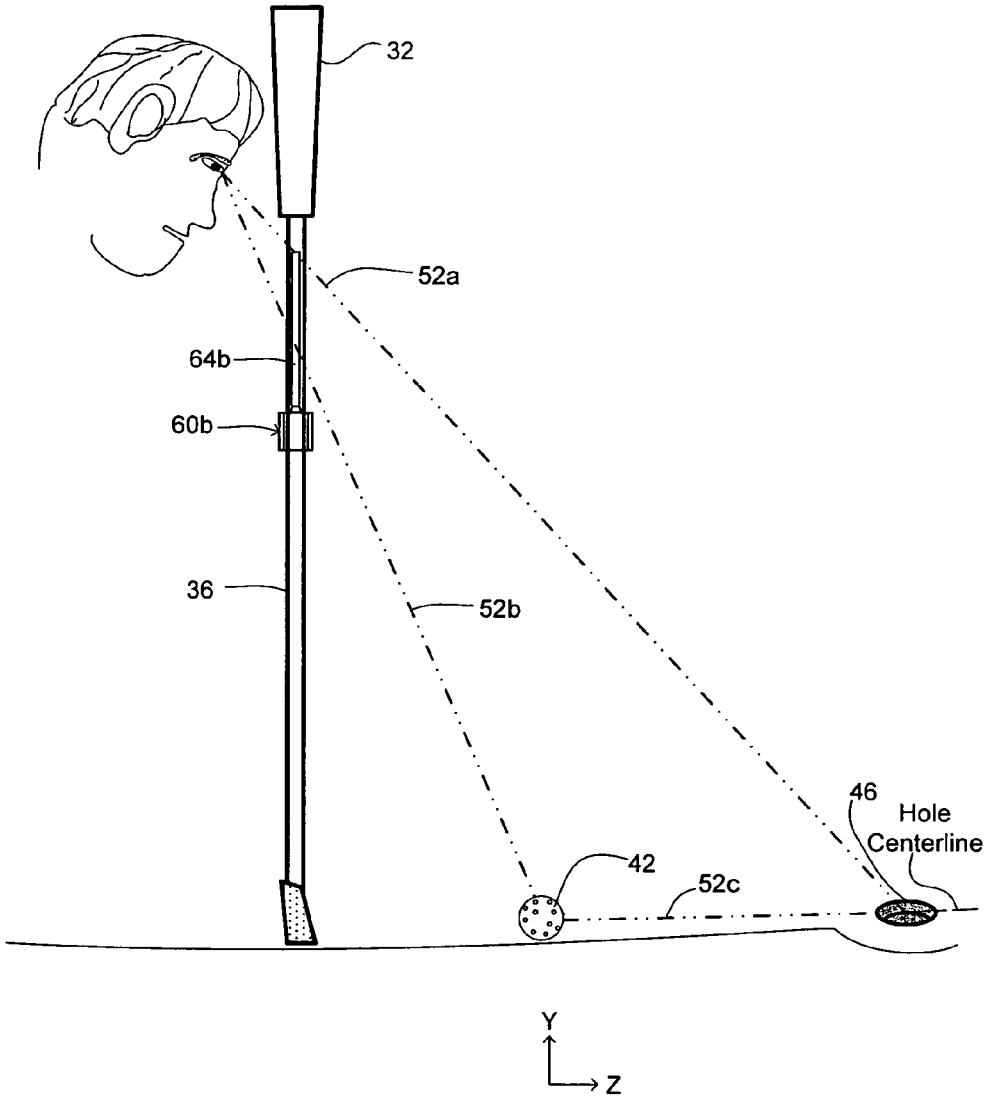
FIG. 20 is a side elevational view of the putter, the site orienting device shown in FIGS. 10 and 17 attached thereto; a ball, a target hole on the green, wherein a user views the ball and the hole using the vertical rod of the putter site orienting device along lines 52*a*, 52*b*, and 52*c* as shown in FIG. 20.

The top or second free end of the rod is within the golfer's sight as long as he is looking directly at an elevated side view of the rod such as along the rod's longitudinal axis 80*a*, 80*b* in FIGS. 9 and 18 and along line 52*a* shown in FIG. 20R. In other words, the golfer may move the shaft to align the rod with the indicia 44 marked on the ball and with the centerline of the target hole as shown in FIGS. 9 and 18. The rod acts as a sighting device to aid the golfer in aiming the club towards the target hole and ensuring that the putter is properly positioned in a same plane bounded by lines 52*a*, 52*b*, 52*c*, as shown in FIG. 20, in alignment with the hole centerline 52*c* along which ball rolls illustrated in FIG. 20. After assuring that the shaft 36 is in the plane of the golfer's line of sight, the golfer is able to properly position his posture, feet placement and the like to stand in a desired location proximate to the ball and properly angle the putter so as to allow for optimal positioning of the putter to contact the ball and reach the target hole.

Though the device of the invention has been shown in the illustrated embodiments as a portable device for attachment to a putter, it is within the scope of the invention to provide the device as an integral part of the club per se.

In an embodiment of the invention shown in FIGS. 10-19, the vertical rod has a tapered mount on the second end 68*b* adapted to be received within the opening 34 of the gripping section 32, the tapered mount 90 has a narrow section 92 around the rigid rod 64*b* closer to the rod second free end 68*b* and a wider section 94 at the rod first end 66*b*.

When not in use, storage of the putter site orienting device 60*b* may be through the opening of the putter grip such that the narrow section 92 of the mount 90 is placed within the opening 34 and the mount 90 is then friction fit within the opening 34 to be retained within the opening 34 until removed for further use.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the embodiments of the invention without departing from the spirit and scope of the appended claims.

What is claimed is:

1. A putter site orienting device for providing a linear alignment between a putter having a shaft including a first and a second side with a shaft longitudinal axis, a gripping portion having an opening disposed therein, a putting head and associated putter head face at an end of the shaft remote from the gripping portion extending outwardly perpendicular from the shaft longitudinal axis and from the first side of the shaft, a golf ball having indicia marked thereon, and target golf hole on the green having a centerline comprising:

a putter shaft attaching portion having at least one contoured face adapted to attach to and slide along a length of a putter shaft;

at least one magnet integrally formed with the putter shaft attaching portion adapted to magnetically secure the putter site orienting device to a putter shaft;

a thin rigid rod having a longitudinal axis and a diameter Dr substantially smaller then a diameter Dp of a golf club putter shaft integrally formed with the putter shaft attaching portion including a first end integrally formed with the putter shaft attaching portion, and a second free end opposite the first end wherein the rigid rod protrudes outwardly and perpendicularly from the shaft attaching portion to allow proper alignment of a putter to which the putter site orienting device attaches with respect to both a golf ball and to a target golf hole.

2. The putter site orienting device of claim 1, wherein the putter shaft attaching portion further comprises:

a planar top surface having a first outer profile;

a bottom planar surface opposing the top surface having a second outer profile the same as the first outer profile of the top planar surface;

a pair of opposing sides each having a pair of opposing first and second substantially parallel faces, and a pair of opposing third and fourth angled faces;

a rear contoured face adapted to attach to the shaft bound between the respective first and second parallel faces and between the top and bottom planar surfaces; and a front face opposing the rear contoured face having slightly rounded edges bound between the respective first and second angled faces and the top and bottom planar surfaces.

3. The putter site orienting device of claim 2, wherein the magnet is disposed through the planar top surface, and wherein the magnet is placed through the top planar surface remote from the front face in closer proximity to the rear contoured face than to the front face.

4. The putter site orienting device of claim 2, wherein the rigid rod comprises:

an elongated member remote from the rear contoured face in closer proximity to the front face.

5. The putter site orienting device of claim 2, wherein the rear contoured face comprises:

a complementary concave shape to a convex shape of a putter shaft adapted to partially encircle a putter shaft, and wherein the rear contoured face fits snugly along a given section of the shaft of the putter such that the rigid rod is parallel to the shaft longitudinal axis.

6. The putter site orienting device of claim 1, wherein the putter site orienting device is attached at any point along the putter shaft as desired by the user to facilitate the orientation of the putter with respect to the golf ball and the target hole.

7. The putter site orienting device of claim 6, wherein when the putter site orienting device is removably secured to the shaft, the second free end of the rigid rod extends in a direction parallel to the shaft longitudinal axis away from the putting head and towards the gripping section so that the second free end of the rigid thin rod is closer to the putter gripping section than the first end.

8. The putter site orienting device of claim 7, wherein the putter site orienting device remains removably secured to the shaft in magnetic contact with the shaft until a stronger force than the magnetic force overcomes the magnetic force to separate the putter site orienting device from the shaft.

9. The putter site orienting device of claim of claim 7, wherein the putter site orienting device is disposed on the second side of the shaft remote from the first side of the shaft from which the putting head extends outwardly wherein the putter shaft attaching portion attaches to a putter shaft so that the rigid thin rod is oriented substantially parallel to a longitudinal axis of the putter shaft and is vertically oriented so that the second free end of the rigid thin rod is closer to the putter gripping section than the first end.

10. The putter device of claim 1, wherein the rigid rod further comprises:

a tapered mount integrally formed with the rigid rod near the second free end of the rigid rod where a wide section is closer to the rigid rod first end and a narrow section is closer to the rigid rod second free end, wherein the wide section has a larger diameter than the than the diameter of the rigid rod Dr.

11. A method of using a putter site orienting device comprising:

providing a golf putter having a shaft with a shaft longitudinal axis including a first and a second side, a gripping portion having an opening disposed therein, a putting head and associated putting head face at an end of the shaft remote from the gripping portion extending outwardly perpendicularly from the shaft longitudinal axis and from the first side of the shaft, a golf ball having indicia marked thereon, and target golf hole on the green having a centerline;

providing a putter site orienting device having a putter attaching portion including a magnet integrally formed therewith that attaches to the shaft and a rigid rod having a rod longitudinal axis, a first end integrally formed with the putter attaching portion, and a second free end extending perpendicularly outwardly from the putter attaching portion;

attaching the putter site orienting device to the second side of the shaft in a direction opposite of the direction of the putting head so that the second free end extends towards the gripping section and away from the putting head in closer proximity to the gripping section than the first end;

adjusting the putter position to cause the longitudinal axis the rod to appear to be aligned with a centerline of the ball as indicated by the marked indicia on the ball, and further aligned with a centerline of a target hole in an X-Y plane.

12. The method of claim 11, further comprising:

adjusting shaft to align the rod with the indicia marked on the ball and with the centerline of the target hole, where the rod acts as a sighting device to aid the golfer in aiming the club towards the target hole and ensuring that the putter is properly positioned in a same plane bounded by a first line formed between the second free end of the rod and the target hole, a second line formed between the eye of a user and the marked indicia on the ball, and a third line formed between a centerline of the ball and a centerline of the target hole along which ball rolls.

13. The method of claim 12, further comprising:

positioning the golfer's stance in a desired location proximate to the ball; and angling the putter so as to allow for optimal positioning of the putter to contact the ball and reach the target hole.

14. The method of claim 11, further comprising:

storing the putter site orienting device in the gripping portion opening.

15. A method of using a putter site orienting device comprising:

providing a golf putter having a shaft with a shaft longitudinal axis including a first and a second side, a gripping portion having an opening disposed therein, a putting head and associated putting head face at an end of the shaft remote from the gripping portion extending outwardly perpendicularly from the shaft longitudinal axis and from the first side of the shaft, a golf ball having indicia marked thereon, and a target golf hole on a green having a centerline;

providing a putter site orienting device having a putter attaching portion including a magnet integrally formed therewith that attaches to the shaft and a rigid rod including a tapered mount, a rigid rod longitudinal axis, a first end integrally formed with the putter attaching portion, and a second free end extending perpendicularly outwardly from the putter attaching portion;

attaching the putter site orienting device to the second side of the shaft in a direction opposite of the direction of the putting head so that the second free end extends towards the gripping section and away from the putting head in closer proximity to the gripping section than the first end;

adjusting the putter position to cause the longitudinal axis of the rigid rod to appear to be aligned with a centerline of the ball as indicated by the marked indicia on the ball, and further aligned with the centerline of the target hole in an X-Y plane.

16. The method of using the putter site orienting device including the rigid rod tapered mount of claim 15, further comprising:

storing the putter site orienting device in the gripping portion opening.

17. The method of using the putter site orienting device including the tapered mount of claim 16, further comprising:

inserting the rigid rod into the gripping portion opening, securing the rigid rod to the gripping portion opening by a friction fit between the tapered mount and the opening of the gripping section.

* * * * *